US006715984B2

(12) United States Patent
Nakajima et al.

(10) Patent No.: US 6,715,984 B2
(45) Date of Patent: Apr. 6, 2004

(54) STALL PREDICTION METHOD FOR AXIAL FLOW COMPRESSOR

(75) Inventors: Takurou Nakajima, Tokyo (JP); Nobuyuki Tahara, Tokyo (JP); Masahiro Kurosaki, Tokyo (JP)

(73) Assignee: Ishikawajima-Harima Heavy Industries Co., Ltd., Tokyo (JP)

( * ) Notice: Subject to any disclaimer, the term of this patent is extended or adjusted under 35 U.S.C. 154(b) by 0 days.

(21) Appl. No.: 10/165,927

(22) Filed: Jun. 10, 2002

(65) Prior Publication Data

US 2003/0007860 A1 Jan. 9, 2003

(30) Foreign Application Priority Data

Jun. 11, 2001 (JP) ..... P2001-175745

(51) Int. Cl.[7] ..... F01D 25/00
(52) U.S. Cl. ..... 415/1; 415/118; 415/914
(58) Field of Search ..... 415/1, 118, 914; 416/42, 61

(56) References Cited

U.S. PATENT DOCUMENTS 5,915,917 A * 6/1999 Eveker et al. ..... 415/1
6,098,010 A * 8/2000 Krener et al. ..... 701/100
6,231,306 B1 * 5/2001 Khalid ..... 416/26

* cited by examiner

*Primary Examiner*—Ninh H. Nguyen
(74) *Attorney, Agent, or Firm*—Fish & Richardson P.C.

(57) ABSTRACT

In order to provide a stall prediction method for an axial flow compressor, a high response pressure sensor is provided in a duct wall adjacent to the leading edge of the rotor blade and a rotating stall is predicted by computing autocorrelation of pressure data obtained as a time history data. The initiation of rotating stall is determined when the autocorrelation of the time history data starts dropping rapidly. When it is determined that the rotating stall is imminent, generation of the rotating stall is prevented by taking necessary countermeasures such as to reduce the fuel supply.

11 Claims, 2 Drawing Sheets

FIG. 3
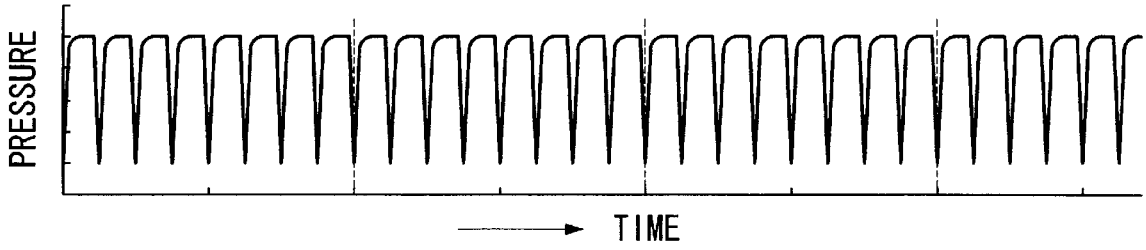
FIG. 4A
TOTAL PRESSURE AT DOWNSTREAM OF ROTOR BLADES
FIG. 4B
AUTO-CORRELATION OF PRESSURE ON CASING WALL AT LEADING EDGE OF ROTOR BLADES
FIG. 4C
AUTO-CORRELATION OF PRESSURE ON CASING WALL AT LEADING EDGE OF ROTOR BLADES
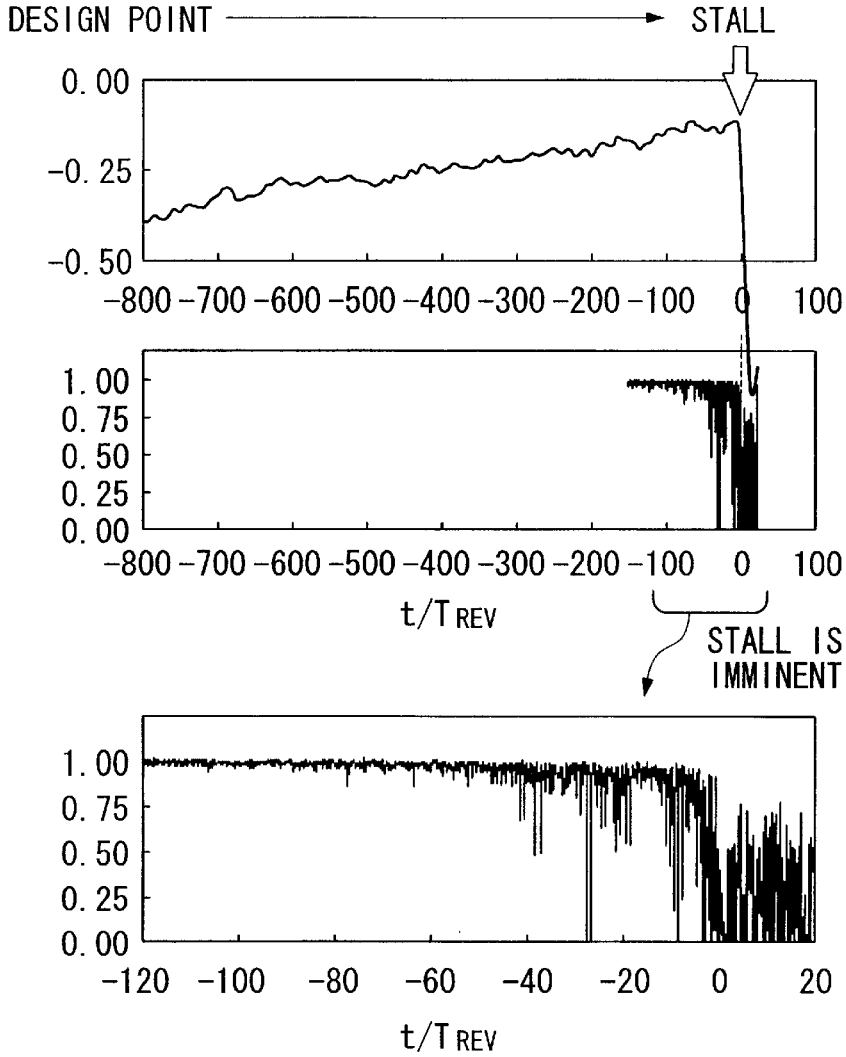
CHANGE OF AUTO-CORRELATION

STALL PREDICTION METHOD FOR AXIAL FLOW COMPRESSOR

BACKGROUND OF THE INVENTION

1. Field of the Invention

The present invention relates to axial flow compressors used on such as gas-turbine engines or jet engines, and in particular, relates to a method for predicting inception of a rotating stall in these axial flow compressors.

2. Description of the Related Art

In general, efficiency of an axial flow compressor such as a gas turbine compressor or a jet engine increases as the pressure ratio increases and as air flow supplied into the compressor decreases. However, in the vicinity of the peak pressure ratio, an unstable phenomenon called a stall occurs and the compression efficiency remarkably decreases. Conventionally, in order to avoid occurrence of the stall, the axial flow compressors are operated under a condition, apart from the operating condition, which is likely to cause the stall. Accordingly, it was not possible to operate conventional axial compressors at relatively high efficiency. On the other hand, when an axial compressor enters into the fully developed stalled state, although it is possible to detect the stall occurrence by compressor discharge pressure drop or by noise from the compressor, a technology to predict the stall or prediction of the stall initiation is not realized yet.

SUMMARY OF THE INVENTION

The present invention was made to solve the above-described problems and the object of the present invention is to provide a method of predicting the stall occurrence of an axial flow compressor, including a method for reliably predicting the operating condition is in the vicinity of stall occurrence point, and a method for increasing the pressure ratio to a peak thereof by controlling the operating conditions of the axial flow compressor, and a method of improving the efficiency of the axial flow compressor.

In order to solve the subject of the present invention, the stall prediction method of the axial flow compressor by the present invention comprises a pressure sensor provided on a casing wall adjacent to a leading edge of the rotor blade thereof, and the stall prediction is performed by monitoring the time history data output by the aforementioned pressure sensor.

Since the air flow is least stable in the vicinity of the leading edge of the rotor blade, it is possible to find the smallest change of the air flow and to predict the stall occurrence in advance by providing the pressure sensor adjacent to the leading edge of the rotor blade.

According to one aspect of the present invention, it provides a pressure sensor adjacent to the leading edge of the rotor blade and the stall inception can be predicted by the time sequential data obtained by the above-described pressure sensor.

Since the air flow is not disturbed adjacent to the leading edge of the rotator blade till immediately before the stall arises, provision of the pressure sensor on the casing wall adjacent to the leading edge of the rotor blade makes it possible to reliably predict occurrence of the stall by monitoring the time history data output from the pressure sensor. Therefore, since it is possible to operate the compressor at conditions close to the peak efficiency, the efficiency can be dramatically increased.

In the present stall prediction method, the time history data output from the pressure sensor are divided into a plurality of data sets for respective unit cycle time and the stall prediction is performed by calculating the autocorrelation of one cycle data set comparing with a previous cycle data set or with a data set several cycles before. Thus, the transition process of the inter-blade flow to the stall cell can be detected.

According to one aspect of the present invention, plural sensors are provided in the axial direction of the rotor, so that it is possible to rapidly detect the imminent stall.

Since the time span to calculate the autocorrelation value is set to a data corresponding to one rotor blade, it is possible to rapidly calculate the autocorrelation.

According to the present invention, the stall prediction method detects the stall by monitoring a time history data output from the pressure sensor provided on the casing wall adjacent to the leading edge of the rotor blade facing the leading edge at twelve o'clock location.

The present invention is capable of predicting the stall by a sensor at a location where disturbance first appears. For example, when a gas turbine is started after being stopped for a certain period, sometimes the stall occurs if that period is comparatively short. This is because, when an engine stops, although the lower portion of the compressor duct cools rapidly, the upper portion of the compressor duct cools slowly, so that sometimes the clearance between the end tip of the rotor blade and the inner surface of the casing wall becomes larger, and this larger clearance sometimes causes the stall. When the pressure sensor is located at the upper portion of the duct where the stall is most liable to occur, it is possible to provide the fastest indication.

The stall prediction method of the present application makes it possible to predict the stall inception at the earliest time by the processing method of data provided from a high response pressure sensor placed on the casing wall at circumferential location where rotating stall is likely to start and axial location close to the leading edge of the rotator blade

BRIEF DESCRIPTION OF THE DRAWINGS

FIG. 3 is one example of the time sequential data (time history data) output from the high response pressure sensor during the flow of the axial flow compressor is in the steady state.

FIGS. 4A, 4B, and 4C are diagrams showing the output of the signal processing device, wherein FIG. 4A is a diagram explaining a entire backward pressure of the rotor blade from the design point to the time of the stall, 4B is a diagram explaining the autocorrelation of the surface pressure of the LE (leading edge) wall, and 4C is an enlarged diagram showing near the stalled point in FIG. 4B.

DETAILED DESCRIPTION OF THE INVENTION

Figure 1:
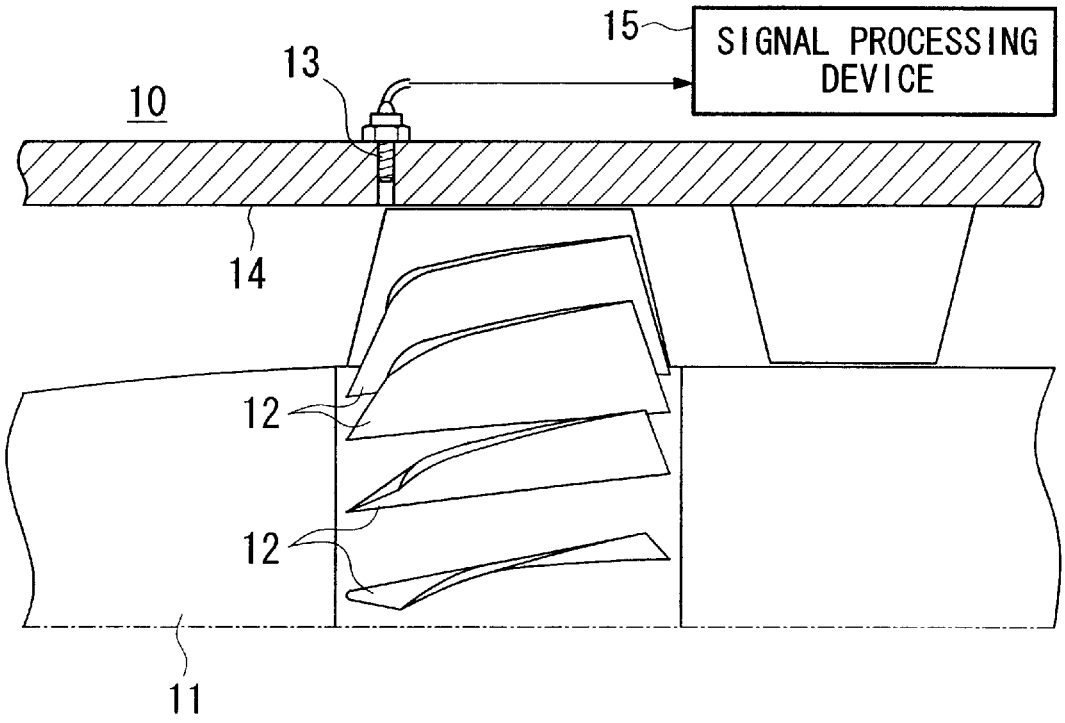
FIG. 1 is a cross-sectional diagram showing of the main portion of an axial flow compressor indicating how a high response pressure sensor is mounted.
Figure 2:
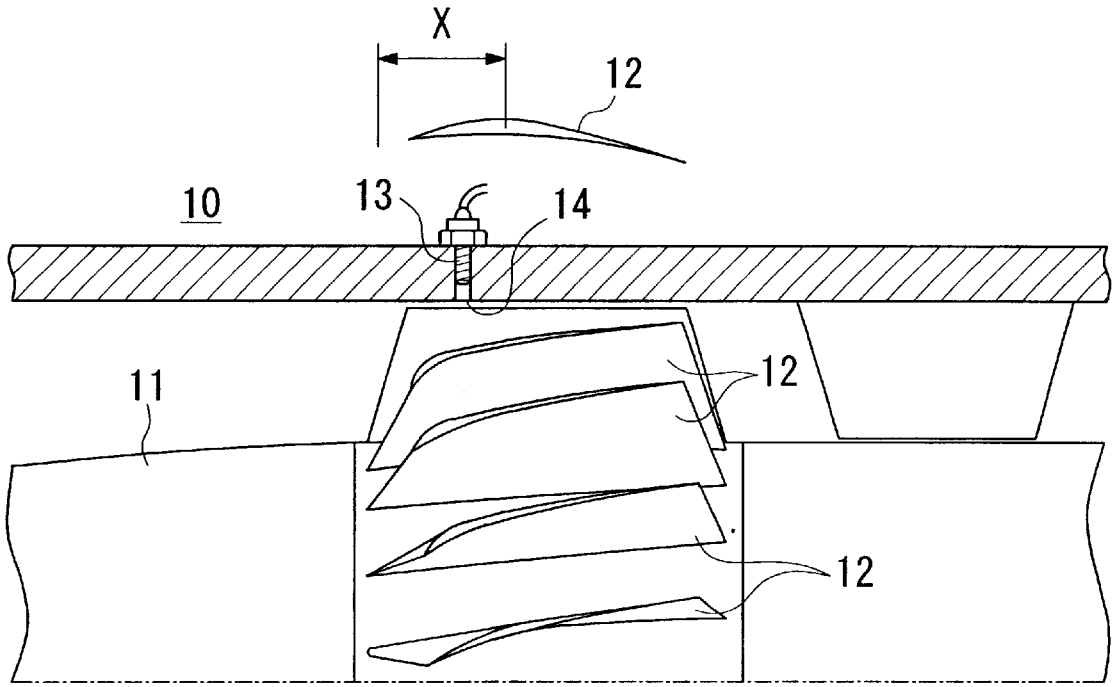
FIG. 2 is a cross-sectional diagram showing the installing location of the high response pressure sensor.

One embodiment of the stall prediction method according to the present invention is described below with reference to the attached drawings. FIG. 1 is a cross-sectional diagram showing of the main portion of an axial flow compressor indicating how a high response pressure sensor is mounted. FIG. 2 is a cross-sectional diagram showing the installing location of the high response pressure sensor.

As shown in FIG. 1, an axial flow compressor 10 comprises a rotor 11 and a plurality of rotor blades 12 mounted around the periphery of the rotor 11. A duct wall 14 is provided covering around the rotor blades 12 mounted around the rotor 11. In the duct wall 14, a high response pressure sensor 13 is mounted. The high response pressure sensor 13 is disposed so as not to be protrude from the inside surface of the duct wall 14. The high response pressure sensor 13 measures the pressure caused due to rotation of the rotor blades 12 and outputs the measured results to the signal processing device 15.

As shown in FIG. 2, the high response pressure sensor 13 is disposed facing the position adjacent to the leading edge of the rotor blade 12 to where the thickness thereof becomes maximum. Here, a dimension shown by a symbol X in FIG. 2 includes upstream which shows similar indication to the leading edge of the rotor blade 12.

The high response pressure sensor 13 is mounted buried in the duct wall 14 facing the rotor blade 12. When the duct is viewed from the front surface, the high response pressure sensor is disposed at the position of the twelve o'clock.

A stall prediction method using the measured data of the high response pressure sensor 13, mounted adjacent to the leading edge of the rotor blade 12, will be described below with reference to FIGS. 3, 4A, 4B, and 4C. FIG. 3 is one example of the time history data output from the high response pressure sensor during a flow of the axial flow compressor is in the steady state. FIGS. 4A, 4B, and 4C are diagrams showing processing results of signals output from the high response pressure sensor by the signal processing device 15.

By the rotation of the rotor blade 12, the high response pressure sensor 13 outputs a time sequential signal as shown in FIG. 3. In FIG. 3, the horizontal axis represents time, and the vertical axis represents the measured pressure. The time history data shown in FIG. 3 shows the output of the high response pressure sensor 13 located at the position of X adjacent to the leading edge of the rotor blade 12 when the axial flow compressor 10 is operating in a steady state at a design point.

As shown in FIG. 3, the waveform of the time history data is periodic due to the periodic passage of the rotor blade 12 rotating in the compressor duct. The peak of the periodic waveform corresponds to the pressure surface of the rotor blade 12 and the abrupt drop of the pressure at the right side of the peak corresponds to the passing of the rotor blade 12 and the bottom of the waveform corresponds to the suction surface of the rotor blade 12.

The time history data by the high response pressure sensor 13 is processed by the signal processing device 15 and the signal processing device outputs the data shown in FIGS. 3, 4A, 4B, and 4C. FIG. 4A is a diagram showing the entire downstream pressure of the rotor blade from the design point to the stall. FIG. 4B is a diagram showing the autocorrelation of the leading edge wall pressure, and FIG. 4C is an enlarged diagram of FIG. 4B.

The horizontal axes of these figures represent time or the rotation speed of the rotor and the time is set to zero when the fully developed stall occurs and the time shown on the horizontal axis represents a time span going back from zero time when the stall occurs. In the present embodiment, as shown in FIGS. 4B and 4C, the output of the duct wall pressure is shown within a time span retroactive to 800 rotations from the stall. The vertical axis of FIG. 4A represents the entire pressure, and the vertical axis of FIG. 4C represents an autocorrelation value.

During designed airflow condition, the waveform of the pressure at present approximately coincides with the waveform of one previous cycle when an identical rotor blade is considered within a time span (data set), and the autocorrelation can be calculated to be approximately 1. Note that the autocorrelation may be calculated by a time span of an identical rotor blade or a time span of one set of rotor blades, if they are calculated within one rotation cycle. Calculation of the autocorrelation between the data set at present and the data set of one previous cycle makes it possible to cancel the minute dimensional differences of rotor blades caused during manufacturing and to accurately detect the slight change of the flow passing through the rotor bladed.

Although the mechanism of stall development is not yet clearly understood, as a consequence, the stall forms a stagnant region called a stall cell, which can be clearly distinguished from the normal through-flow region.

The technical subject of stall prediction is to pinpoint the origin of the formation of the stall cell. However, when the stall cell is formed at the tips of the rotor blades, significant pressure drop occurs after several rotor revolutions, so that detecting a stall cell is too late to predict the stall. As is clearly shown in FIGS. 4B and 4C, the autocorrelation shows a sharp drop just before the stall occurs. In the present invention, it is determined that the stall is imminent when the abrupt drop of the autocorrelation below a predetermined standard is observed. That is, the transition process from the through-flow to the stall cell is determined by the change of the autocorrelation.

When an inception of the stall is detected, predetermined countermeasures are taken so as to prevent development of the stall. The countermeasures include reduction of the fuel supply or reduction of the discharge pressure of the compressor by bleeding air.

Note that it is possible to improve the accuracy of the stall prediction by providing a high response pressure sensor in the duct wall surface 14 facing a blade region of X. The flow in the vicinity of the trailing edge is turbulent, even when the compressor is operating in steady condition at the design conditions, so that it is difficult to catch an indication of the stall inception in an accurate manner by providing the pressure sensor at this location.

In contrast, since the flow near the leading edge of the rotor blade 12 is most stable, it is desirable for accurate and reliable detection of the indication to dispose the high response pressure sensor adjacent to the leading edge as a position in the axial direction.

As explained above, the flow is not disturbed until just before the stall initiation at a location adjacent to the leading edge of the rotor blade 12, it is possible to catch an indication of the stall based on the time history data obtained by a high response pressure sensor 13 disposed close to the leading edge of the rotor blade.

Since the autocorrelations can be obtained at a comparatively light calculation load, the pressure signal can be processed rapidly and it is possible to spot the transition of the flow from the inter-blade through flow to the stall cell within a short period of time.

In addition, since the high response pressure sensor does not protrude to the inside of the compressor duct, the pressure sensor does not disturb the flow through the duct.

It has been empirically known that the rotating stall of an axial flow compressor develops starting near the tips of the rotor blade and tip clearance leakage disturbing blade through flow is interpreted as one of the reasons.

In addition, when an engine is re-started within a relatively short period of time after the previous engine shutdown, it is known that the rotating stall is likely to occur. Since the lower side duct of the compressor is cooled comparatively sooner than the upper side duct, the reason for the rotating stall is because the clearance between the blade and the duct wall at the upper side is larger than that the lower side of the duct.

Accordingly, although the high response pressure sensor can be disposed in any circumferential position of the duct, it is effective to dispose it at a circumferential position of the duct for the stall prediction if there is a proper position where the rotating stall is initiated.

In contrast, if there is no specific circumferential position where the rotating stall is initiated, by the reason described above, it is preferable to dispose the high response pressure sensor in the twelve o'clock location (at the upper side duct).

In the above description, although an explanation is proved in which one high response pressure sensor 13 is mounted facing the leading edge of the rotor blade, it is possible to arrange a plurality of high response pressure sensors in axial direction of the duct of the compressor for the purpose of redundancy. It is also possible to arrange a plurality of high pressure sensors in the circumferential direction of the compressor duct.

What is claimed is:

1. A stall prediction method for an axial flow compressor, comprising the steps of:

providing a pressure sensor in a duct wall facing adjacent to a leading edge of a rotor blade; and predicting the stall of the axial flow compressor in accordance with time history data obtained by said pressure sensor by an autocorrelation analysis of said data.

2. A stall prediction method for an axial flow compressor according to claim 1, wherein said method further comprising the steps of predicting the stall in accordance with a change of an autocorrelation of the serial data obtained by said pressure sensor by computing the autocorrelation between a present set of serial data for a time span and a previous data set for a time span preceding one cycle or a plurality of cycles.

3. A stall prediction method for an axial flow compressor according to claim 2, wherein said time span for computing said autocorrelation is a time history data for one rotor blade.

4. A stall prediction method for an axial flow compressor according to claim 2, wherein said time span for computing said autocorrelation is that of the time history data for a plurality of rotor blades.

5. A stall prediction method for an axial flow compressor according to claim 1, wherein said pressure sensor is disposed in a plural numbers in the axial direction of the axial flow compressor.

6. A stall prediction method for an axial flow compressor according to claim 1, wherein a plurality of said pressure sensors are disposed in the circumferential direction of the axial flow compressor for obtaining time history data at various positions of one rotor blade.

7. A stall prediction method for an axial flow compressor comprising the steps of:

providing a pressure sensor in a duct wall facing adjacent to a leading edge of a rotor blade and in the twelve o'clock location; and predicting the stall of the axial flow compressor in accordance with time history data obtained by said pressure sensor by an autocorrelation analysis of said time history data.

8. A stall prediction method for an axial flow compressor comprising the steps of:

providing a pressure sensor in a duct wall facing adjacent to a leading edge of a blade and at a circumferential position where the stall is first generated; and predicting the stall of the axial flow compressor in accordance with serial data obtained by said pressure sensor by computing an autocorrelation between a present set of serial data for a time span and a previous data set for a time span preceding at least one cycle.

9. A stall prediction method for an axial flow compressor comprising the steps of:

providing a pressure sensor in a duct wall facing adjacent to a leading edge of a rotor blade and in the twelve o'clock direction;

obtaining continuous time history data detected by said pressure sensor;

calculating autocorrelation of said time history data; and predicting the stall of the axial flow compressor by determining that rotating stall is imminent when the autocorrelation of the time history data start dropping rapidly.

10. A stall prediction method for an axial flow compressor according to claim 9, further comprising the step of:

preventing generation of rotating stall by reducing the fuel supply to the axial flow compressor when it is determined that the rotating stall is imminent.

11. A stall prediction method for an axial flow compressor comprising the steps of:

providing a pressure sensor in a duct wall facing adjacent to a leading edge of a rotor blade and in the direction of twelve o'clock;

obtaining continuous time history data detected by said pressure sensor;

calculating autocorrelation of said time history data; and preventing generation of rotating stall by reducing a pressure at an outlet of the axial flow compressor by extracting air when it is determined that the rotating stall is imminent.

* * * * *